US007201216B2

(12) United States Patent
Geiger et al.

(10) Patent No.: US 7,201,216 B2
(45) Date of Patent: Apr. 10, 2007

(54) HEAT EXCHANGER, IN PARTICULAR OIL COOLER FOR A MOTOR VEHICLE

(75) Inventors: Wolfgang Geiger, Ludwigsburg (DE); Karl-Heinz Staffa, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 0 days.

(21) Appl. No.: 11/055,032

(22) Filed: Feb. 11, 2005

(65) Prior Publication Data

US 2005/0194124 A1 Sep. 8, 2005

(51) Int. Cl.
*F28F 9/02* (2006.01)

(52) U.S. Cl. ..... 165/153; 165/179; 165/916

(58) Field of Classification Search ..... None
See application file for complete search history.

(56) References Cited

U.S. PATENT DOCUMENTS

| | | | | |
|---|---|---|---|---|
| 5,121,790 | A * | 6/1992 | Persson | 165/140 |
| 5,538,077 | A | 7/1996 | So et al. | |
| 5,638,900 | A * | 6/1997 | Lowenstein et al. | 165/168 |
| 5,839,646 | A | 11/1998 | Duda et al. | |
| 5,845,706 | A * | 12/1998 | Gruner et al. | 165/177 |
| 6,196,304 | B1 * | 3/2001 | Schwarz | 165/140 |
| 6,341,649 | B1 * | 1/2002 | Joshi et al. | 165/153 |
| 6,988,541 | B2 * | 1/2006 | Nakajima et al. | 165/140 |
| 2001/0004935 | A1 * | 6/2001 | Sanada et al. | 165/110 |
| 2002/0174978 | A1 * | 11/2002 | Beddome et al. | 165/174 |
| 2003/0070793 | A1 | 4/2003 | Dierbeck | |
| 2003/0094260 | A1 * | 5/2003 | Whitlow et al. | 165/41 |
| 2003/0121649 | A1 * | 7/2003 | Seiler et al. | 165/167 |
| 2004/0069477 | A1 * | 4/2004 | Nishikawa et al. | 165/175 |

FOREIGN PATENT DOCUMENTS

| | | |
|---|---|---|
| DE | 195 48 244 A1 | 6/1997 |
| DE | 196 05 340 A1 | 8/1997 |
| EP | 0 444 595 B1 | 9/1991 |
| EP | 0 932 011 B1 | 4/2004 |
| JP | 11-142074 A | 5/1999 |
| WO | WO 92/08090 A1 | 5/1992 |
| WO | WO 94/00726 A1 | 1/1994 |
| WO | WO 99/19683 A1 | 4/1999 |

* cited by examiner

*Primary Examiner*—Allen J. Flanigan
(74) *Attorney, Agent, or Firm*—Foley & Lardner LLP

(57) ABSTRACT

A heat exchanger, preferably an oil cooler (1) for a motor vehicle, comprises stacked flat tubes (2, 3, 4), which have tube ends with apertures for admitting and discharging oil, which flows through the flat tubes (2, 3, 4) in their longitudinal direction. The apertures of adjacent flat tubes (2, 3, 4) are in fluid communication with one another in order to form flow passages, and spacings are left between the flat tubes for a medium, in particular a cooling medium, to pass through. The flat tubes are designed as extruded multi-channel tubes.

23 Claims, 3 Drawing Sheets

HEAT EXCHANGER, IN PARTICULAR OIL COOLER FOR A MOTOR VEHICLE

CROSS-REFERENCE TO RELATED PATENT APPLICATIONS

The right of foreign priority is claimed under 35 U.S.C. § 119(a) based on Federal Republic of Germany Application No. 10 2004 007 510.7, filed Feb. 13, 2004, the entire contents of which, including the specification, drawings, claims and abstract, are incorporated herein by reference.

BACKGROUND OF THE INVENTION

The invention relates to a heat exchanger, in particular an oil cooler for motor vehicles. Various designs are known of oil coolers for motor vehicles, i.e., engine oil coolers or transmission oil coolers. Air-cooled engine oil coolers are arranged in the front engine compartment of the motor vehicle and are cooled by ambient air. Transmission oil coolers are often accommodated in the coolant tanks of the coolant coolers (radiators) and are therefore cooled by the coolant of the engine cooling circuit. Also known are so-called laminate oil coolers, as described for example in the EP-A 932 011. The flow passages for the oil in this case are formed by pairs of laminar plates which comprise two plates connected on their circumferential edges by means of a continuous fold. Metal turbulence inserts are placed between the plates and are brazed to the plates. At their ends, the elongated plates have apertures which are in each case connected to one another to form a distributor manifold and a collection manifold, respectively, which have oil inlet and outlet connection pieces. The laminate oil cooler is arranged in a coolant tank made from plastic and is connected to a transmission oil circuit via the oil inlet and outlet connection pieces. The individual plates are held spaced apart by intermediate rings and/or studs and form a stack through which coolant can flow. All the parts of the laminate oil cooler which consist of aluminum or stainless steel are brazed together. This requires accurate manufacturing with very small tolerances of all the parts which are to be joined; these parts are generally clad with a brazing material. Furthermore, this mode of design also requires a large number of individual parts.

A similar design of laminate oil coolers has been disclosed in U.S. Pat. No. 5,538,077, in which elongate plate pairs are in each case constructed from two plates with a metal turbulence plate between them, and these parts are brazed to one another at their circumferences. At the ends of the plate pairs there are apertures for supplying and discharging the oil. The apertures are brazed together by means of stamped formations and are thereby formed into distribution and collection manifolds, so that oil can flow through the entire stack of plate pairs in parallel. On the secondary side, the plate pairs, which in each case form gaps between them as a result of the provision of studs, have coolant flowing through them. This known laminate oil cooler also has the drawback of requiring a large number of parts and relatively high manufacturing costs.

JP-A 11-142074 likewise discloses a laminate oil cooler which is arranged in a metallic coolant tank of a radiator and is cooled by engine coolant. Apertures, in which slotted tubes for supplying and discharging the oil are arranged, are provided at the end sides of the plate pairs. The laminate oil cooler can be brazed together with its connection tubes and the coolant tank.

Another design of oil cooler is characterized by flat tubes, as described, for example, in EP-A 444,595, which is commonly assigned with the present application. The flow passages for the oil are in this case formed by flat tubes produced from an aluminum or steel sheet and are welded by means of longitudinally running weld seams. A turbulence insert is introduced into the closed flat tube and brazed to the flat tube, which may be clad with a brazing composition, in order to increase the resistance to internal pressure. Apertures are provided at the ends of the flat tubes and are connected to the apertures of adjacent flat tubes, so as to form in each case one distribution manifold and one collection manifold for the oil. Unlike in the case of the laminate oil coolers, the flat tubes have to be closed at their ends. In the case of the known flat tube oil cooler, this is done by means of an end-side fold, which has a corrugated contour in order to increase the rigidity. In the case of air cooling, a suitable arrangement of fins is provided between the flat tubes.

A further flat tube oil cooler has been disclosed by DE-A 196 05 340, also commonly assigned, wherein the flat tubes are closed off at their ends by a solid insert part. One problem with the flat tube design is that, unlike in the case of the laminated oil coolers, it is difficult to apply the compressive force required to braze the turbulence inserts and the end closure insert part. If the pressure is insufficient, the brazing gaps are too large and brazing is incomplete, which leads to leaks or "swelling" in the flat tubes.

SUMMARY OF THE INVENTION

It is one object of the present invention to provide an improved heat exchanger.

It is a particular object of the invention to provide an improved oil cooler, and especially one that can be produced at lower cost, can be brazed using the Nocolok brazing process and requires a smaller number of individual parts.

It is also an object of the invention to provide an improved motor vehicle embodying the heat exchanger according to the invention.

Still another object of the invention is to provide an improved method of manufacturing a heat exchanger, especially a heat exchanger that can be used as a motor vehicle oil cooler.

In accordance with one aspect of the present invention, there has been provided a heat exchanger suitable for use as an oil cooler for a motor vehicle, comprising: a plurality of stacked flat tubes, wherein respective ends of the tubes include apertures for respectively admitting and discharging a fluid which is to be cooled by flowing through the flat tubes in their longitudinal direction, the respective apertures of adjacent flat tubes being in fluid communication with one another in order to form flow passages, wherein the flat tubes define between themselves spacings for a cooling medium to pass through and wherein the flat tubes comprise extruded multi-channel tubes.

In accordance with another aspect of the invention, there has been provided a motor vehicle comprising an oil cooling circuit that includes the heat exchanger as defined above.

In accordance with yet another aspect of the invention, there is provided a method for producing a heat exchanger, comprising: stacking a plurality of flat tubes that comprise extruded multi-channel tubes having a plurality of channels divided by webs, wherein respective ends of the tubes include apertures for respectively admitting and discharging a fluid which is to be cooled by flowing through the flat tubes in their longitudinal direction, and wherein said apertures have a dimension "D" transversely with respect to the longitudinal direction of the flat tubes which corresponds to a distance between at least two of the webs, the tubes being stacked such that respective apertures of adjacent flat tubes are aligned with one another, and such that the flat tubes define between themselves spacings for a cooling medium to pass through; inserting metal closure members into the apertures to close off the ends of at least some of the channels of the multi-channel tube with respect to the outside, the metal closure members being configured to provide fluid communication between respective aligned apertures in order to form flow passages, whereby a stacked tube assembly is produced; and subjecting the stacked tube assembly to a brazing process in order to produce a sealed heat exchanger block.

Further objects, features and advantages of the present invention will become apparent from the detailed description of preferred embodiments that follows, when considered together with the accompanying figures of drawing.

DETAILED DESCRIPTION OF PREFERRED EMBODIMENTS

Figure 1:
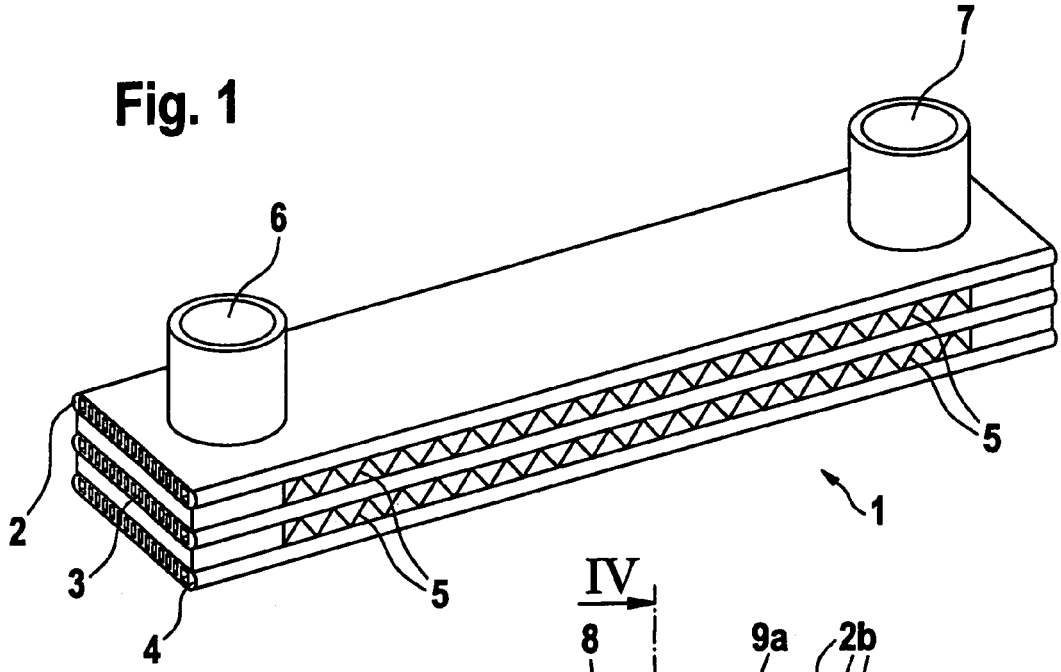
FIG. 1 is a perspective view of an oil cooler according to the invention with extruded multi-channel flat tubes.

According to the invention, flat tubes of the oil cooler are designed as extruded multi-channel tubes. This results in the advantage that the entire oil cooler can be produced from a smaller number of individual parts, which also reduces the oil cooler manufacturing costs. Extruded multi-channel tubes are known, per se, for example, for use in flat tube condensers for motor vehicle air-conditioning systems. Multi-channel tubes with small wall thicknesses and a high resistance to internal pressure can be produced as flat tubes with a multiplicity of channels that are divided from one another by webs. The webs act as tie rods and also improve the conduction of heat to the outside. The production of a welded flat tube or a brazed plate pair, in each case in combination with the insertion and brazing of a turbulence insert in accordance with the prior art, is no longer necessary, since an extruded multi-channel tube can be purchased as a semi-finished product in all desired dimensions. The risk of brazing turbulence inserts is avoided in the case of the multi-channel tube, i.e., the manufacturing quality is improved. The multi-channel tubes are advantageously made from a brazable wrought aluminum alloy. This allows the multi-channel tube to be brazed to other parts of the oil cooler, using, e.g., the inexpensive Nocolok process, i.e., using a non-corrosive flux.

In one preferred embodiment of the invention, apertures are machined into the end regions of the multi-channel tubes, for example, by stamping or laser cutting. Preferably, the apertures extend in the transverse direction, in each case, as far as the outermost webs, i.e., the two outermost channels of the multi-channel tube are not cut into or opened up by the aperture. This achieves the advantage of allowing a fluid connection between the flow passages of multi-channel tubes arranged above one another, i.e., in accordance with a similar design principle to that which is known for laminate or flat tube oil coolers.

According to a further preferred embodiment of the invention, a multi-channel tube is provided with solid narrow sides, so that a significanly thicker wall thickness results in this region of the multi-channel tubes. The contour of the apertures is preferably delimited by two semicircles, which in the region of the solid narrow sides form at least one shoulder against which a metal closure sheet butts that has been inserted into the apertures. This gives the advantage of securing the closure sheet against rotation; the metal closure sheet cannot rotate during assembly of the oil cooler and during brazing, since it is fixed in the circumferential direction by means of the shoulder(s).

In a further preferred embodiment of the invention, the apertures may take various geometric shapes, e.g., circular, semicircular or D-shaped, or alternatively may also be rectangular or square. In each case the transverse extent, i.e., the dimension which is transverse with respect to the longitudinal direction of the multi-channel tube, extends preferably from the outermost web on one side to the outermost web on the other side. The geometry of the channels is substantially preferably rectangular or square, i.e., the webs are preferably arranged perpendicular to the flat sides of the flat tube.

In a further preferred embodiment of the invention, metal closure sheets are inserted into the apertures and, on the one hand, close off the flow passages of the multi-channel tube with respect to the outside, while on the other hand allowing connection to an aperture in an adjacent tube. The metal closure sheets are matched to the shape of the apertures, e.g., for a circular aperture according to the invention, a metal closure sheet in the shape of a semicircle or a half-shell closes off the outer half of the aperture with respect to the outside. The metal closure sheets are preferably clad with a brazing-material and are brazed to the multi-channel tube, which itself—for manufacturing reasons—is preferably not braze-clad. However, it is also possible for the multi-channel tubes to be provided with brazing material and a layer of flux, in a process which follows the extrusion operation.

In a further preferred embodiment of the invention, intermediate rings are arranged between the multi-channel tubes (which, as in the prior art, are arranged parallel to and above one another to form a stack) in the region of the apertures and are pushed over the metal closure sheets. This gives the advantage that, on the one hand, a defined distance is maintained between the multi-channel tubes and, on the other hand, a fluid passage which is sealed on all sides is produced between adjacent apertures. The intermediate rings are braze clad, since the extruded multi-channel tubes are preferably not braze-clad, and therefore the rings can be brazed at their flat sides to the flat sides of the multi-channel tubes. Thus, by stacking multi-channel tubes and intermediate rings on top of one another, in combination with metal closure sheets, it is possible to produce a new oil cooler which corresponds in terms of the flow pattern to the flat tube or laminate oil cooler known in accordance with the prior art.

In a further preferred embodiment of the invention, instead of using the metal closure sheets in the form of half-shells in combination with intermediate plates, it is also possible to use a slotted tube which has peripheral slots in the region of the apertures. A braze-clad, slotted tube of this generally known type can advantageously be used as a stacking and tube spacing aid and produces a fluid connection or communication between the individual apertures and multi-channel tubes after the brazing operation.

In another preferred embodiment of the invention, finned arrangements may be provided between the multi-channel tubes in order to increase the heat transfer surface area, for example, using braze-clad corrugated fins, turbulence inserts or the like, which is advantageous, in particular, in secondary-side air cooling.

Turning now to the drawings, FIG. 1 shows a heat exchanger according to the invention, which is designed as an oil cooler 1 and—in simplified terms—is constructed from three extruded multi-channel flat tubes 2, 3, 4, which are arranged parallel to and at a distance above one another to form a stack. Corrugated fins 5 or the like are arranged between the multi-channel tubes 2, 3, 4 in order to increase the secondary-side heat transfer surface area. The oil cooler 1 has two connection pieces, namely one oil inlet connection piece 6 and one oil outlet connection piece 7, which can be connected to an oil circuit (not shown in further detail) of a motor vehicle.

Figure 2:
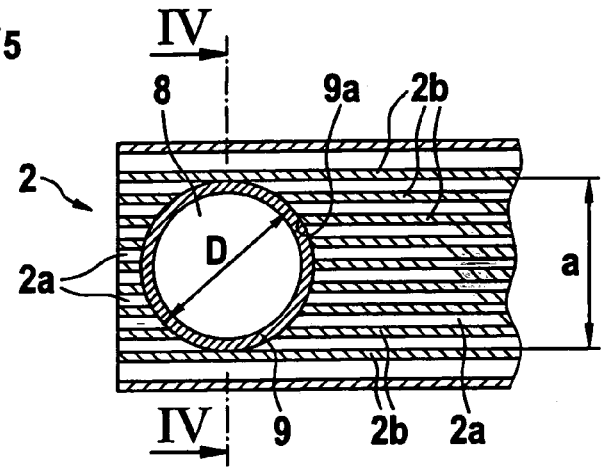
FIG. 2 is a cross-sectional view showing an end portion of a multi-channel tube with an aperture.

FIG. 2 shows a longitudinal section through one of the multi-channel tubes, parallel to the flat sides. The multi-channel tube 2 has a multiplicity of preferably discrete flow passages 2*a*, which are in each case separated from one another by webs 2*b*. A circular aperture 8, i.e., a circular cutout, produced, for example, by stamping, is arranged in the end region of the multi-channel tube 2. It is also possible for the circular cutout 8 to be cut out by a laser or water cutting techniques. Therefore, the aperture 8 is produced by a chipless process, i.e., to prevent any chips from accumulating in the flow passages 2*a* of the multi-channel tube 2, which could lead to contamination of the oil circuit in operation. A slotted tube 9, which has slots 9*a* running in the circumferential direction on its right-hand side (as seen in the drawing) and is continuous on its left-hand side (as seen in the drawing) is inserted into the circular cutout 8. The multi-channel tube 2 is closed off with respect to the outside by this slotted tube 9. On the inside, the slotted tube 9 is in fluid communication with the flow passages 2*b* of the multi-channel tube 2 via the peripheral slots 9*a*. The slotted tube 9 has an external diameter D which corresponds to the distance "a" between the two outermost webs 2*a* of the multi-channel tube 2. These two outermost webs 2*a* are only touched by the circumference of the slotted tube 9, i.e., the outermost webs 2*a* are continuous and are brazed to the circumference of the slotted tube 9.

Figure 3:
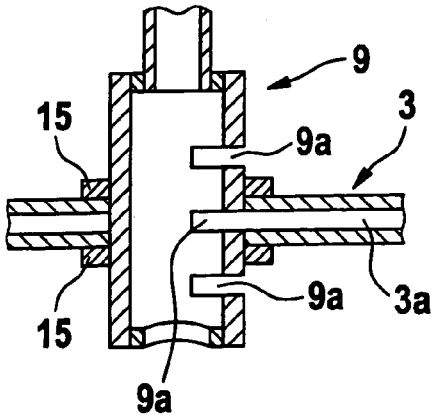
FIG. 3 is a cross-sectional view showing a slotted tube for oil distribution.

FIG. 3 shows the slotted tube 9 in cross section, partially illustrating the middle multi-channel tube 3. The upper and lower multi-channel tubes 2, 4 have been omitted in order to simplify the illustration. It can be seen that the slotted tube 9 is in fluid communication with the flow passages 3*b* of the multi-channel tube 3 via the circumferential gap 9*a*, whereas the multi-channel tube 3 is closed off with respect to the outside. The slotted tube 9 therefore acts as a distributor tube or as a collector tube for the oil flowing in or out. Brazing material clad intermediate rings 15, which are brazed to the adjacent multi-channel tubes (not shown here) and thereby form a seal, are arranged above and below the multi-channel tube 3.

Figure 4:
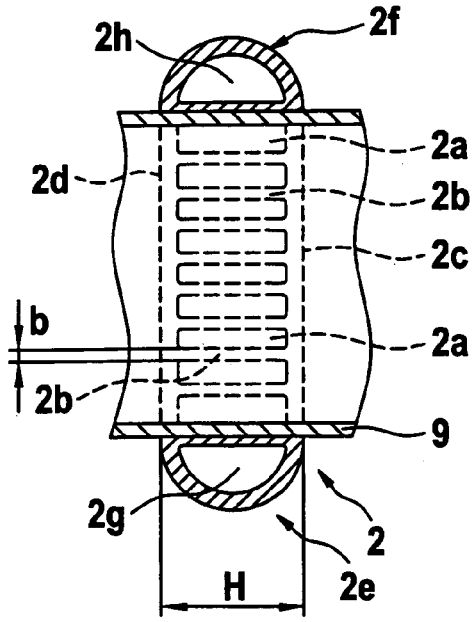
FIG. 4 is a cross-sectional view showing an extruded multi-channel tube along plane IV—IV in FIG. 2.

FIG. 4 shows a section in plane IV—IV in FIG. 2, i.e., a further longitudinal section through the distributor tube 9 and a cross section through the multi-channel tube 2, which is illustrated by dashed line. The extruded multi-channel tube 2 has a flat-oval cross section, with a flat top side 2*c* and a flat underside 2*d*, as well as two rounded narrow or end sides 2*e*, 2*f* The webs 2*b* are arranged perpendicular to the flat sides 2*c*, 2*d*, and the outer peripheral lines (outer circumference) of the distributor tube 9 run parallel to the outermost webs 2*b* and are in contact therewith, so that brazing can be performed there. The two semi-circular chambers 2*g*, 2*h* remain open, and therefore the coolant which cools the oil cooler 1 can flow through them. In a preferred embodiment, the total height H of the multi-channel tube 2 is preferably in the range from about $2.0 \leqq H \leqq 4.0$ mm, and the web width "b" of the multi-channel tube 2 is preferably in the range from about $0.15 \leqq b \leqq 0.6$ mm.

Figure 5:
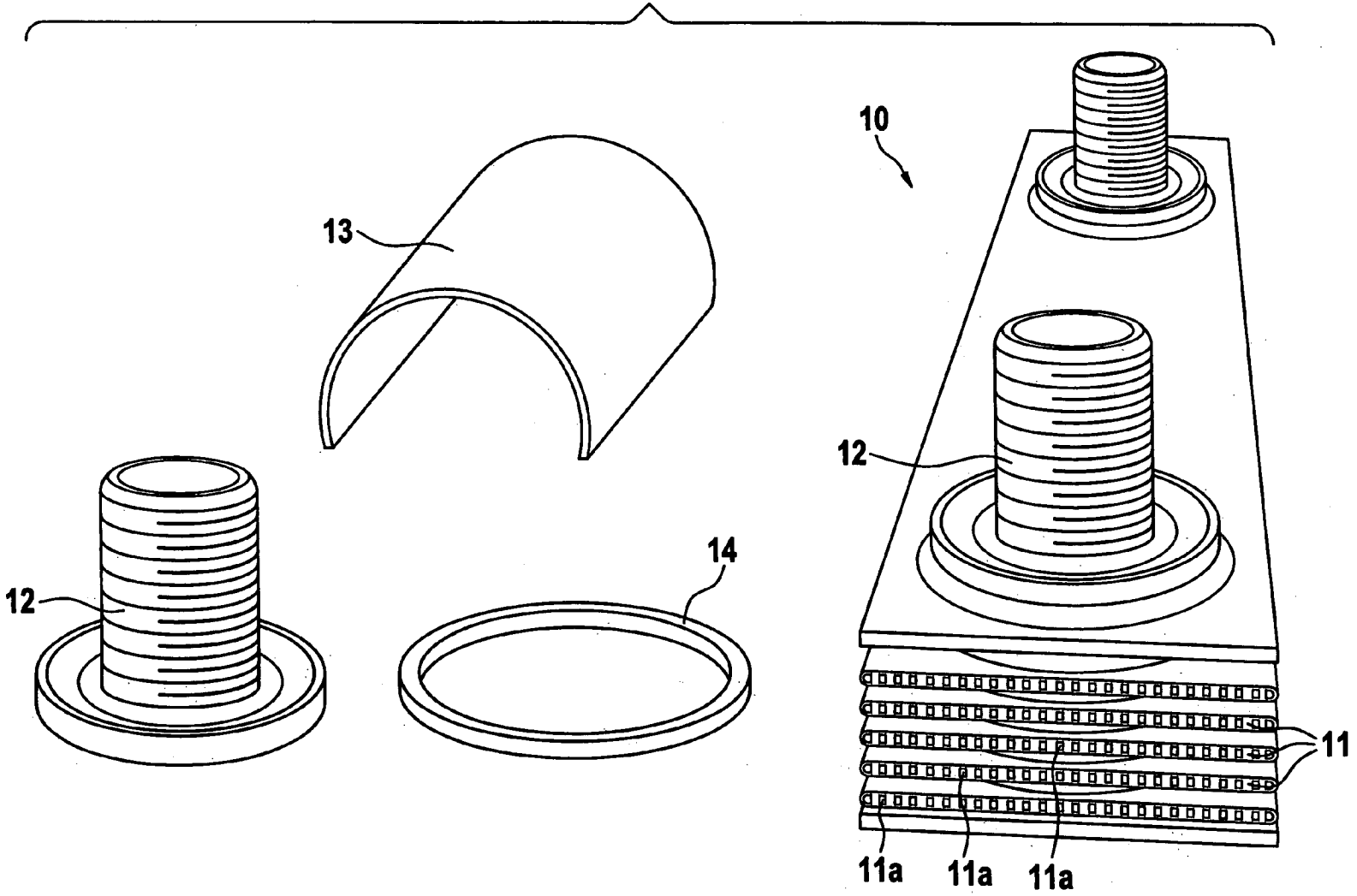
FIG. 5 is an exploded view illustrating an oil cooler according to the invention with individual parts.

FIG. 5 shows an exploded illustration of a further exemplary embodiment of the invention, with a modified distributor tube or distribution member. FIG. 5 shows a flat tube oil cooler 10, as seen in the direction looking onto its narrow side, i.e., onto the end sides of the extruded multi-channel tubes 11, which have a multiplicity of small flow passages 11*a*. An oil connection piece 12 for the entry or discharge of the oil can be seen in the front region on the top side of the oil cooler 10. The connection piece 12 is additionally illustrated as an individual part in the left-hand part of the figure. FIG. 5 also shows a tube 13 in the form of a half-shell and an intermediate ring 14, the internal diameter of which corresponds to the external diameter of the half-shell tube 13. The two elements 13, 14 serve as a distribututor or collection tube, the function of which corresponds to the slotted distributor tube 9 shown in FIGS. 2 to 4. The tube 13 in the form of a half shell, also referred to as a metal closure sheet, is inserted into the apertures (in accordance with FIG. 2) in such a manner that the multi-channel tubes are closed off with respect to the outside but remain open on the inside. An intermediate ring 14 is pushed over the metal closure sheet 13, which is in the form of a half-shell, and the next multi-channel tube in the stack then bears on this intermediate ring 14. The intermediate rings 14 therefore function as spacer rings for maintaining a defined spacing between the multi-channel tubes, and on the other hand, in combination with the metal half-shell closure sheet 13, they also form a fluid passage by closing off the missing part in the circumference of the metal closure sheet. The finished stack, comprising multi-channel tubes 11, inserted metal closure sheets 13 and intermediate rings 14, is brazed together to form a sealed cooler block. For this purpose, both the metal closure sheet 13 and the intermediate ring 14 are preferably clad with brazing material. On account of the extrusion operation, the extruded multi-channel tubes cannot normally be braze-clad, but they are preferably made from a brazable wrought aluminum alloy; therefore, the other parts also consist of aluminum alloys.

All parts of the oil cooler 10, and also of the oil cooler 1, can therefore be brazed, specifically using the inexpensive and well-known Nocolok process, which works without corrosive flux residues and permits wide manufacturing tolerances. This process is described in commonly assigned DE-A 195 48 244, which is incorporated by reference in its entirety.

The oil connection pieces of both oil coolers can be brazed into a metallic coolant tank of an all-aluminum cooler, e.g., radiator.

Figure 6:
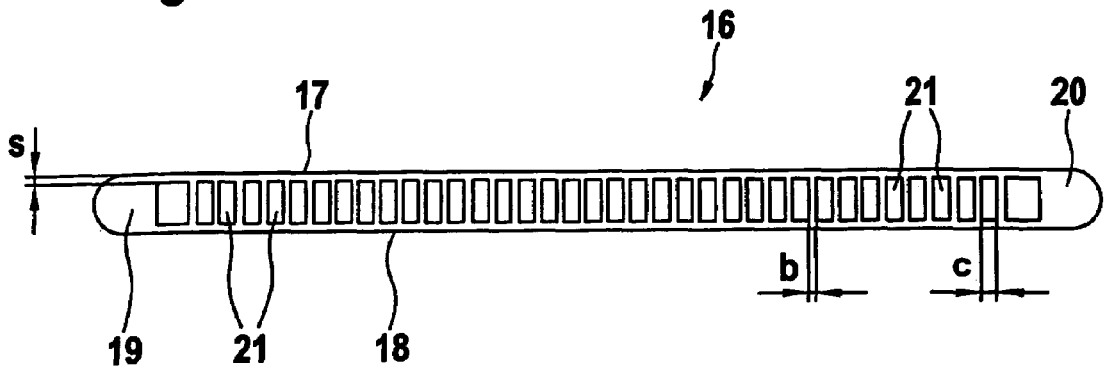
FIG. 6 is an end view showing a modified embodiment of a multi-channel tube.

FIG. 6 shows a modified multi-channel tube 16, with a flat top side 17, a flat underside 18 and two rounded narrow sides 19, 20 which, at least in the region where they are rounded, are of solid design, i.e., have a significantly greater wall thickness than the top side 17 and underside 18. Moreover—in a similar way to the previous exemplary embodiment in accordance with FIG. 4—the multi-channel tube 16 has a series of approximately rectangular channels 21, the width "c" of which is preferably in a range from about $0.5 \leqq c \leqq 0.8$ mm. The wall thickness "s" of the top side 17, and of the underside 18 is in a range from about $0.2 \leqq s \leqq 0.4$ mm.

Figure 7:
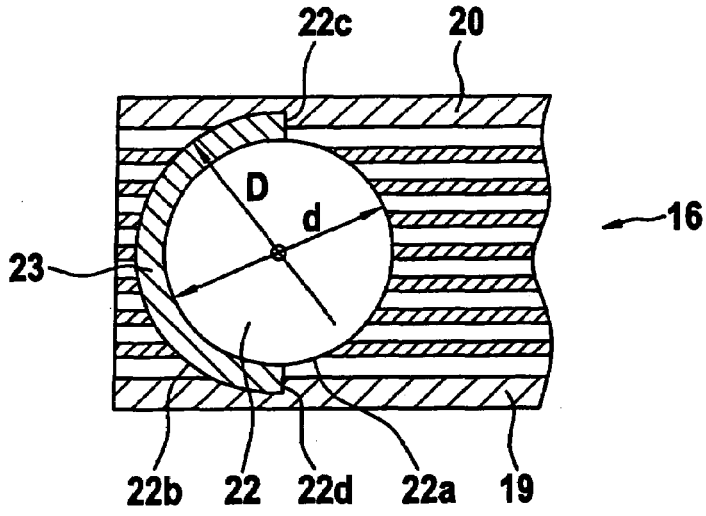
FIG. 7 is a cross-sectional view showing an end portion of the multi-channel tube shown in FIG. 6, with a modified aperture and metal closure sheet.

FIG. 7 shows an end portion of the multi-channel tube 16 (on a different scale than FIG. 6) with an aperture 22. The aperture 22 has a contour which is composed of two semicircles 22*a*, 22*b* of different diameters, namely "d" and "D". In the region of the solid narrow sides 19, 20, the contour of the aperture 22 is completed by two shoulders 22*c*, 22*d* which connect the two semicircles 22*a*, 22*b* to one another. This contour can be stamped out of the multi-channel tube 16 by means of a corresponding stamp having different diameters "d" and "D". A metal closure sheet 23 in the form of a half-shell is inserted into the semicircle shape having the diameter "D", and the end edges of this metal closure sheet 23 butt against the shoulders 22*c*, 22*d*, thereby securing it against rotation. The difference between the two diameters "D" and "d" preferably corresponds to (double) the wall thickness of the metal half-shell closure sheet 23.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A heat exchanger suitable for use as an oil cooler for a motor vehicle comprising:

a plurality of stacked flat metal tubes, wherein respective ends of the tubes include apertures for respectively admitting and discharging a fluid which is to be cooled by flowing through the flat metal tubes in their longitudinal direction, the respective apertures of adjacent flat metal tubes being in fluid communication with one another in order to form flow passages, wherein the flat metal tubes define between themselves spacings for a cooling medium to pass through, wherein the flat metal tubes comprise extruded multi-channel tubes of solid unitary construction, and wherein the multi-channel tubes have a plurality of channels divided by integral webs, wherein the plurality of webs extend from the top of the flat metal tubes to the bottom of the flat metal tubes to define the channels, wherein said apertures have a dimension "D" arranged transversely with respect to the longitudinal direction of the flat metal tubes, wherein the dimension "D" corresponds to the distance "a" between two outermost webs, wherein the two outermost webs each define respective outermost channels so that the two outermost webs are between the two outermost channels.

2. A heat exchanger as claimed in claim 1, wherein the multi-channel tubes are produced from a brazable wrought aluminum alloy.

3. A heat exchanger as claimed in claim 1, wherein the apertures are in the shape of a circle or semicircle with a diameter "D" which is equal to the distance "a."

4. A heat exchanger as claimed in claim 1, further comprising metal closure sheets, fitted into the apertures to close off the ends of the multi-channel tube with respect to the outside.

5. A heat exchanger as claimed in claim 3, wherein one metal closure sheet passes through all the adjacent apertures.

6. A heat exchanger as claimed in claim 1, further comprising intermediate rings arranged between the multi-channel tubes in the region of the apertures.

7. A heat exchanger as claimed in claim 1, wherein the height "H" of the multi-channel tube is in the range from $2.0 \leqq H \leqq 4.0$ mm.

8. A heat exchanger as claimed in claim 1, wherein the web width "b" of the webs is in the range from $0.15 \leqq b \leqq 0.6$ mm.

9. A heat exchanger as claimed in claim 1, wherein the multi-channel tube has a wall thickness "s" in the range from $0.2 \leqq s \leqq 0.4$ mm.

10. A heat exchanger as claimed in claim 1, wherein the multi-channel tube has channels with a channel width "c" in the range from $0.5 \leqq c \leqq 0.8$ mm.

11. A heat exchanger as claimed in claim 1, wherein the shape of the channels is rectangular or square.

12. A heat exchanger as claimed in claim 1, further comprising braze-clad turbulence inserts or fins arranged between the multi-channel tubes.

13. A heat exchanger as claimed in claim 1, wherein the apertures are produced by a chipless separating processes.

14. A motor vehicle comprising an oil cooling circuit that includes the heat exchanger as defined in claim 1.

15. A heat exchanger as claimed in claim 1, wherein the webs are arranged perpendicular to the top and bottom of the flat metal tubes.

16. A heat exchanger as claimed in claim 1, wherein the two outermost channels are not in fluid communication with the apertures.

17. A heat exchanger as claimed in claim 4, wherein the metal closure sheets comprise slotted tubes with peripheral slots, wherein the peripheral slots are arranged to communicate with open cross sections of the multi-channel tubes.

18. A heat exchanger as claimed in claim 4, wherein the metal closure sheets and the intermediate rings are clad with a layer of brazing material.

19. A heat exchanger suitable for use as an oil cooler for a motor vehicle comprising:

a plurality of stacked flat tubes, wherein respective ends of the tubes include apertures for respectively admitting and discharging a fluid which is to be cooled by flowing though the flat tubes in their longitudinal direction, the respective apertures of adjacent flat tubes being in fluid communication with one another in order to form flow passages, wherein the flat tubes define between themselves spacings for a cooling medium to pass through, wherein the flat tubes comprise extruded multi-channel tubes, and wherein the multi-channel tubes have narrow transverse edges, wherein the transverse edges are of solid design, and wherein the apertures have a dimension "D" transversely with respect to the longitudinal direction of the flat tubes which extends into the solid edges.

20. A heat exchanger as claimed in claim 19, wherein the apertures are in the form of two concentric semicircles of different diameters "d,""D," forming two shoulders, and wherein the shoulders are arranged in the solid edges.

21. A heat exchanger as claimed in claim 19, wherein the tubes have rounded narrow edges.

22. A heat exchanger suitable for use as an oil cooler for a motor vehicle comprising:

a plurality of stacked flat metal tubes, wherein respective ends of the tubes include apertures for respectively admitting and discharging a fluid which is to be cooled by flowing through the flat metal tubes in their longitudinal direction, the respective apertures of adjacent flat metal tubes being in fluid communication with one another in order to form flow passages, wherein the flat metal tubes define between themselves spacings for a cooling medium to pass through, wherein the flat metal tubes comprise extruded multi-channel tubes of solid unitary construction, and wherein the multi-channel tubes have a plurality of channels divided by integral webs, wherein the plurality of webs extend from the top of the flat metal tubes to the bottom of the flat metal tubes to define the channels, further comprising metal closure sheets, fitted into the apertures to close off the ends of the multi-channel tube with respect to the outside, wherein the metal closure sheets comprise half-shells with a semicircular cross section.

23. A method for producing a heat exchanger suitable for use as an oil cooler for a motor vehicle, comprising:

stacking a plurality of flat metal tubes that comprise extruded multi-channel tubes having a plurality of channels divided by integral webs, wherein the webs extend from the top of the flat metal tubes to the bottom of the flat metal tubes to define the channels, wherein the extruded multi-channel tubes have a solid unitary construction, wherein respective ends of the tubes include apertures for respectively admitting and discharging a fluid which is to be cooled by flowing through the flat metal tubes in their longitudinal direction, wherein said apertures have a dimension "D" arranged transversely with respect to the longitudinal direction of the flat metal tubes which corresponds to a distance "a" between two outermost webs, wherein the two outermost webs each define respective outermost channels so that the two outermost webs are between the two outermost channels, the tubes being stacked such that respective apertures of adjacent flat metal tubes are aligned with one another, wherein the flat metal tubes define between themselves spacings for a cooling medium to pass through;

inserting metal closure members into the apertures to close off the ends of at least some of the channels of the multi-channel tube with respect to the outside, the metal closure members being configured to provide fluid communication between respective aligned apertures in order to form flow passages, whereby a stacked tube assembly is produced; and subjecting the stacked tube assembly to a brazing process in order to produce a sealed heat exchanger block.

* * * * *

UNITED STATES PATENT AND TRADEMARK OFFICE

CERTIFICATE OF CORRECTION

PATENT NO. : 7,201,216 B2
APPLICATION NO. : 11/055032
DATED : April 10, 2007
INVENTOR(S) : Wolfgang Geiger and Karl-Heinz Staffa It is certified that error appears in the above-identified patent and that said Letters Patent is hereby corrected as shown below:

Title page, item

(30) Foreign Application Priority Data should read as:

February 13, 2004 (DE) 10 2004 007 510.7

Signed and Sealed this

Twelfth Day of June, 2007

JON W. DUDAS
*Director of the United States Patent and Trademark Office*